US010178733B2

(12) United States Patent
Ghasemi Afshar

(10) Patent No.: US 10,178,733 B2
(45) Date of Patent: Jan. 8, 2019

(54) LIGHT EMITTING ASSEMBLY AND METHOD FOR OPERATING A LIGHT EMITTING ASSEMBLY

(71) Applicant: OSRAM GmbH, Munich (DE)

(72) Inventor: Farhang Ghasemi Afshar, Wenzenbach (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 15/949,119

(22) Filed: Apr. 10, 2018

(65) Prior Publication Data

US 2018/0295694 A1 Oct. 11, 2018

(30) Foreign Application Priority Data

Apr. 10, 2017 (DE) ..... 10 2017 206 122
Sep. 18, 2017 (DE) ..... 10 2017 121 575

(51) Int. Cl.
*H05B 37/02* (2006.01)
*H05B 33/08* (2006.01)

(52) U.S. Cl.
CPC ..... *H05B 33/0857* (2013.01); *H05B 33/0824* (2013.01); *H05B 33/0863* (2013.01);
(Continued)

(58) Field of Classification Search
CPC ..... H05B 33/086; H05B 33/0845; H05B 37/0218; H05B 33/0824; H05B 33/0827; H05B 33/0812; H05B 33/0857; H05B 33/089; H05B 37/02; H05B 33/0815; H01L 25/0753; H01L 2924/00; H01L 33/504;
(Continued)

(56) References Cited

U.S. PATENT DOCUMENTS 8,669,722 B2 * 3/2014 Yeh ..... H05B 33/0824 315/152
8,890,436 B2 * 11/2014 Chou ..... H05B 37/02 315/153
(Continued)

FOREIGN PATENT DOCUMENTS

DE 10 2012 217 534 A1 3/2014

OTHER PUBLICATIONS

German Search Report based on 10 2017 121 575.1 (7 pages) dated Aug. 17, 2018 (for reference purpose only).

*Primary Examiner* — Vibol Tan
(74) *Attorney, Agent, or Firm* — Viering Jentschura & Partner MBB

(57) ABSTRACT

A light emitting assembly includes a first light emitting component, a second light emitting component, and a third light emitting component. The components are arranged such that a first light, a second light and a third light mix to form a mixed light. The assembly includes a control device, which has a first control channel and a second control channel operating the three components and configured such that in a first operating range the first component is driven via the first channel and the second and third components are driven jointly via the second channel. In the first operating range the mixed light is continuously adjustable from the first color to a fourth color, and in a second operating range the second component is driven via the second channel and the first and third components are driven jointly via the first channel.

17 Claims, 10 Drawing Sheets

(52) U.S. Cl.
CPC ..... *H05B 33/0869* (2013.01); *H05B 37/029* (2013.01); *H05B 37/0227* (2013.01)

(58) Field of Classification Search
CPC ... H01L 33/50; F21Y 2115/10; F21Y 2113/13
See application file for complete search history.

(56) References Cited

U.S. PATENT DOCUMENTS

| | | | | |
|---|---|---|---|---|
| 9,232,602 | B2 | 1/2016 | Yeh et al. | |
| 9,609,715 | B1 * | 3/2017 | Petluri | H05B 33/0845 |
| 9,653,436 | B2 * | 5/2017 | Windisch | H01L 25/0753 |
| 9,719,660 | B1 * | 8/2017 | Petluri | C09K 11/7721 |
| 9,756,696 | B1 * | 9/2017 | Bradford | H05B 33/0866 |
| 2010/0026191 | A1 | 2/2010 | Radermacher et al. | |
| 2015/0245436 | A1 | 8/2015 | Markytan et al. | |
| 2017/0064791 | A1 * | 3/2017 | Shearer | H05B 33/0869 |
| 2017/0223800 | A1 * | 8/2017 | Wu | H05B 33/083 |
| 2017/0352647 | A1 * | 12/2017 | Raymond | H01L 25/0753 |

* cited by examiner

FIG 11

| | cx | cy | PHI [lm] | I [mA] | #LED |
|---|---|---|---|---|---|
| WW | 0.4647472 | 0.417156 | 1598.265 | 80 | 30 |
| CW | 0.2757816 | 0.296316 | 1119.646 | 80 | 20 |
| G | 0.3501816 | 0.416664 | 621.93 | 80 | 10 |

| cx | cy | PHI [lm] | CCT |
|---|---|---|---|
| 0.36751908 | 0.3669134 | 3339 | 4314 |

FIG 12

| | cx | cy | PHI [lm] | I [mA] | #LED |
|---|---|---|---|---|---|
| WW | 0.4644268 | 0.417204 | 2314.425 | 120 | 30 |
| CW | 0.2750972 | 0.2950964 | 9.38 | 1 | 20 |
| G | 0.3508104 | 0.417876 | 891.13 | 120 | 10 |

| cx | cy | PHI [lm] | CCT | |
|---|---|---|---|---|
| 0.4322283 | 0.41688653 | 3215 | 3187 | G+WW |

FIG 13

| | cx | cy | PHI [lm] | I [mA] | #LED |
|---|---|---|---|---|---|
| WW | 0.46509984 | 0.4161023 | 14.631 | 1 | 30 |
| CW | 0.2764104 | 0.296924 | 1605.646 | 120 | 20 |
| G | 0.3508104 | 0.417876 | 891.13 | 120 | 10 |

| cx | cy | PHI [lm] | CCT | |
|---|---|---|---|---|
| 0.29823062 | 0.33152646 | 2511 | 7296 | G+CW |

| | cx | cy | PHI [lm] | I [mA] | CCT |
|---|---|---|---|---|---|
| WW | 0.4641865 | 0.4164 | 2814 | 150 | |
| CW | 0.2750893 | 0.295098 | 146 | 10 | |
| G | 0.3494893 | 0.415236 | 82 | 10 | |
| | 0.44860672 | 0.40831477 | 3041 | | 2848 |
| WW | 0.4642642 | 0.416772 | 2651 | 140 | |
| CW | 0.2751144 | 0.295164 | 295 | 20 | |
| G | 0.3495144 | 0.415326 | 164 | 20 | |
| | 0.43406491 | 0.40104255 | 3110 | | 3030 |
| WW | 0.4643447 | 0.417036 | 2484 | 130 | |
| CW | 0.2751711 | 0.295286 | 440 | 30 | |
| G | 0.3495711 | 0.415464 | 245 | 30 | |
| | 0.4208438 | 0.39434197 | 3170 | | 3218 |
| WW | 0.4644268 | 0.417204 | 2314 | 120 | |
| CW | 0.2752552 | 0.295452 | 582 | 40 | |
| G | 0.3496552 | 0.415644 | 324 | 40 | |
| | 0.40870685 | 0.38813326 | 3221 | | 3416 |
| WW | 0.4645093 | 0.417288 | 2141 | 110 | |
| CW | 0.2753625 | 0.29565 | 722 | 50 | |
| G | 0.3497625 | 0.41586 | 401 | 50 | |
| | 0.39745843 | 0.38234628 | 3263 | | 3522 |
| WW | 0.464591 | 0.4173 | 1964 | 100 | |
| CW | 0.2754888 | 0.295868 | 857 | 60 | |
| G | 0.3498888 | 0.416106 | 477 | 60 | |
| | 0.38693437 | 0.3769182 | 3298 | | 3840 |

FIG 14B

| | | | | | |
|---|---|---|---|---|---|
| WW | 0.4646707 | 0.417252 | 1783 | 90 | |
| CW | 0.2756299 | 0.296094 | 990 | 70 | |
| G | 0.3500299 | 0.416376 | 550 | 70 | |
| | 0.37699487 | 0.37179169 | 3323 | | 4070 |
| WW | 0.4647472 | 0.417156 | 1598 | 80 | |
| CW | 0.2757816 | 0.296316 | 1120 | 80 | |
| G | 0.3501816 | 0.416664 | 622 | 80 | |
| | 0.36751908 | 0.3669134 | 3340 | | 4314 |
| WW | 0.4648193 | 0.417024 | 1410 | 70 | |
| CW | 0.2759397 | 0.296522 | 1246 | 90 | |
| G | 0.3500299 | 0.416376 | 550 | 70 | |
| | 0.35866117 | 0.36006675 | 3206 | | 4557 |
| WW | 0.4648858 | 0.416868 | 1219 | 60 | |
| CW | 0.2761 | 0.2967 | 1369 | 100 | |
| G | 0.3498888 | 0.416106 | 477 | 60 | |
| | 0.34939111 | 0.35290629 | 3064 | | 4848 |
| WW | 0.4649455 | 0.4167 | 1023 | 50 | |
| CW | 0.2762583 | 0.296838 | 1489 | 110 | |
| G | 0.3497625 | 0.41586 | 401 | 50 | |
| | 0.33958893 | 0.34533801 | 2913 | | 5204 |
| WW | 0.4649972 | 0.416532 | 825 | 40 | |
| CW | 0.2764104 | 0.296924 | 1606 | 120 | |
| G | 0.3496552 | 0.415644 | 324 | 40 | |
| | 0.32911191 | 0.33724559 | 2754 | | 5652 |
| WW | 0.4650397 | 0.416376 | 622 | 30 | |
| CW | 0.2765521 | 0.296946 | 1719 | 130 | |
| G | 0.3495711 | 0.415464 | 245 | 30 | |
| | 0.31778786 | 0.32848417 | 2586 | | 6235 |
| WW | 0.4650718 | 0.416244 | 416 | 20 | |
| CW | 0.2766792 | 0.296892 | 1829 | 140 | |
| G | 0.3495144 | 0.415326 | 164 | 20 | |
| | 0.30540579 | 0.31887163 | 2410 | | 7028 |
| WW | 0.4650923 | 0.416148 | 206 | 10 | |
| CW | 0.2767875 | 0.29675 | 1937 | 150 | |
| G | 0.3494893 | 0.415236 | 82 | 10 | |
| | 0.2917031 | 0.30817659 | 2224 | | 8165 |

LIGHT EMITTING ASSEMBLY AND METHOD FOR OPERATING A LIGHT EMITTING ASSEMBLY

CROSS-REFERENCE TO RELATED APPLICATION

This application claims priority to German Patent Application Serial No. 10 2017 206 122.7, which was filed Apr. 10, 2017, and is incorporated herein by reference in its entirety. This application further claims priority to German Patent Application Serial No. 10 2017 121 575.1, which was filed Sep. 18, 2017, and is incorporated herein by reference in its entirety.

TECHNICAL FIELD

Various embodiments relate generally to a light emitting assembly and to a method for operating a light emitting assembly.

BACKGROUND

A conventional light emitting assembly (referred to as: light engine) includes, three, four or more light emitting components and a control device for operating the light emitting components. A light emitting component can be for example an LED or an OLED. The control device includes a plurality of electronic components. An electronic component may include for example an active and/or a passive component. An active electronic component may include for example a computing, storage and/or regulating unit and/or include a transistor. A passive electronic component may include for example a capacitor, a resistor, a diode or a coil.

A light emitting assembly that is tunable with regard to the color temperature (referred to as: CCT tunable light engine) makes it possible to provide white light having different color temperatures. By way of example, a color temperature of the light which is emitted by a light emitting assembly of this type can be continuously adjusted from warm white to cold white. Depending on the time of day and/or the space in which the light is provided, the desired color temperature can be set by means of the control device.

FIG. 1 shows a chromaticity diagram, e.g. the CIE standard chromaticity diagram. Within the chromaticity diagram, each point is representative of a color of light. A pair including an X-value and a Y-value of the chromaticity diagram corresponds to each point in the chromaticity diagram, wherein the pair can be defined by $c_X$, $c_Y$. In the context of this application, one color is defined by exactly one pair of color coordinates. A different pair of color coordinates represents a different color. Consequently, different types of for example white, red, green, and/or blue may exist, each be represented by individual color coordinates and, at least in the context of this application, each be designated as different colors. The color of a radiation emitted by a black body according to Planck corresponds to the temperature of said black body. In the chromaticity diagram, a Planckian locus 20 is defined by the colors which the light of the black body has depending on the temperature thereof. The corresponding temperature is referred to as the color temperature. In the chromaticity diagram, the Planckian locus 20 extends from a warm white color region at the bottom left to a cold white color region at the top right. In the context of this application, white light of different color temperatures is also referred to as light of different colors. In particular, in the context of this application, cold white light has a different color than warm white light. All colors represented by color coordinates which lie on the Planckian locus 20 can be referred to as white, but can be differentiated by their color temperature. Points near the Planckian locus 20 can also correspond to white light, the corresponding light being perceived by a human being generally as white or at least as approximately white, possibly with a hue corresponding to the respective point. By way of example, light of a first color 22 can still be perceived as warm white and light of a second color 24 can still be perceived as cold white. In contrast thereto, light defined by points that are far away from the Planckian locus 20 is no longer perceived as white. By way of example, light of a third color 26 is perceived as green.

If two light sources that emit light of different colors is used for providing light, and the corresponding light is mixed to form a mixed light, then depending on a driving of the corresponding light sources the color of the mixed light can be set within the chromaticity diagram along a straight line connecting the points which correspond to the colors of the light emitted by the individual light sources. By way of example, if one light source provides light of the first color 22 and one light source provides light of the second color 24, the mixed light, depending on the driving of the two light sources, can be set along a first straight line 32 extending from the first color 22 to the second color 24. As an alternative thereto, if one light source provides light of the third color 26 and one light source provides light of the second color 24, the mixed light, depending on the driving of the two light sources, can be set along a second straight line 34. As an alternative thereto, if one light source provides light of the first color 22 and one light source provides light of the third color 26, the mixed light, depending on the driving of the two light sources, can be set along a third straight line 36.

If three light sources that emit light of different colors are used for providing light, and the corresponding light is mixed to form a mixed light, then depending on an individual driving of the corresponding light sources the color of the mixed light can be set within the chromaticity diagram along and within a triangle whose vertices form the three points corresponding to the colors of the light emitted by the individual light sources. By way of example, by means of a light emitting assembly including three light sources that emit light of the first color 22, of the second color 24 and of the third color 26, respectively, depending on the driving of the light sources, mixed light could be generated whose color lies on the triangle or within the triangle whose vertices form the three colors 22, 24, 26.

Nowadays, essentially two approaches are known for realizing light emitting assemblies that are tunable with regard to the color temperature.

In the first approach, three optical channels, that is to say at least three light sources, which emit light of three different colors, are driven independently of one another by means of corresponding three control channels. The light sources are chosen such that the colors of the corresponding light span within the chromaticity diagram a triangle containing part of the Planckian locus 20. An individual driving of the three optical channels by means of the corresponding three control channels then makes it possible to generate light whose color is tunable precisely along the Planckian locus 20. A corresponding driving of the optical channels is complex, however, and a control device comprising suitable three control channels is costly.

In the second approach, only two optical channels, that is to say only two light sources, which emit light of different colors, and only two control channels, for individually driving the corresponding two optical channels, are used for cost reasons. By way of example, a first light source, which emits warm white light, for example light of the first color 22, and a second light source, which emits cold white light, for example light of the second color 24, can be used. By means of driving the two light sources via the corresponding control channels, it is then possible to set the color of the mixed light along the first straight line 32. However, the straight line 32 has only two points of intersection with the Planckian locus 20 and otherwise lies distinctly above or below the Planckian locus 20. Therefore, apart from two exceptions the color of the generated mixed light is distinctly remote from the Planckian locus 20 and the corresponding light is distinctly perceptively not white in wide ranges.

SUMMARY

A light emitting assembly includes a first light emitting component, a second light emitting component, and a third light emitting component. The components are arranged such that a first light, a second light and a third light mix to form a mixed light. The assembly includes a control device, which has a first control channel and a second control channel operating the three components and configured such that in a first operating range the first component is driven via the first channel and the second and third components are driven jointly via the second channel. In the first operating range the mixed light is continuously adjustable from the first color to a fourth color, and in a second operating range the second component is driven via the second channel and the first and third components are driven jointly via the first channel.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which:

FIG. 11 shows one example of a first table;

FIG. 12 shows one example of a second table;

FIG. 13 shows one example of a third table;

DESCRIPTION

Figure 1:
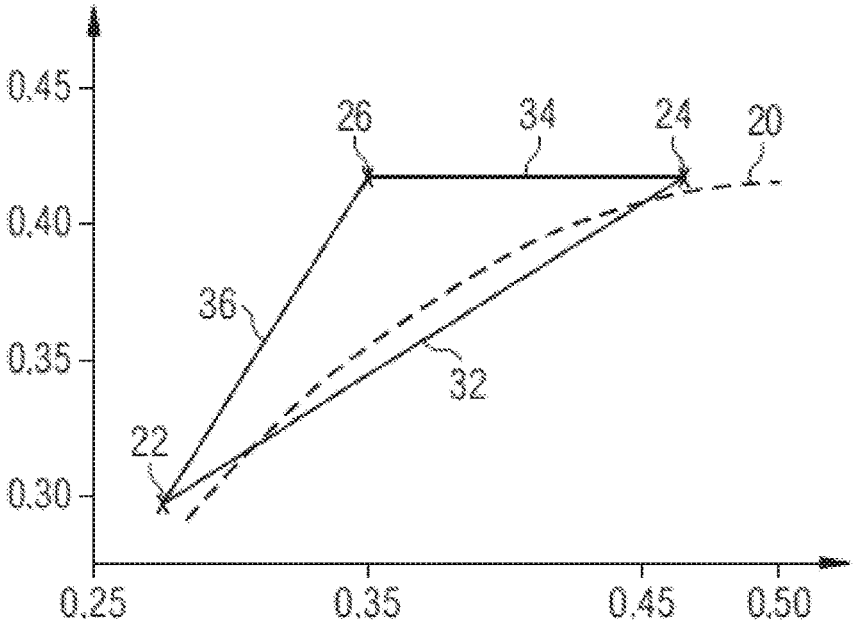
FIG. 1 shows one example of a chromaticity diagram.

In the following detailed description, reference is made to the accompanying drawings, which form part of this description and show for illustration purposes specific exemplary embodiments in which the invention can be implemented. Since component products of embodiments can be positioned in a number of different orientations, the direction terminology serves for illustration and is not restrictive in any way whatsoever. It goes without saying that other exemplary embodiments can be used and structural or logical changes can be made, without departing from the scope of protection of the present invention. It goes without saying that the features of the various embodiments described herein can be combined with one another, unless specifically indicated otherwise. Therefore, the following detailed description should not be interpreted in a restrictive sense, and the scope of protection of the present invention is defined by the appended claims. In the figures, identical or similar elements are provided with identical reference signs, in so far as this is expedient.

Various embodiments provide a light emitting assembly which emits light whose color is continuously tunable between warm white and cold white and/or whose color is perceived as white or at least approximately white, and/or which is constructed in a simple manner and/or is producible in a cost-effective manner.

Various embodiments provide a method for operating a light emitting assembly which can be performed in a simple and/or cost-effective manner and/or which makes it possible to provide light whose color is continuously tunable between warm white and cold white and/or whose color is perceived as white or at least approximately white.

Various embodiments provide a light emitting assembly, including: a first light emitting component, which emits light of a first color; a second light emitting component, which emits light of a second color, which is different than the first color; at least one third light emitting component, which emits light of a third color, which is different than the first color and the second color, wherein the light emitting components are arranged such that the first light, the second light and the third light mix to form a mixed light; and a control device, which has a first control channel and a second control channel for the purpose of operating the three light emitting components and which is configured such that in a first operating range the first light emitting component is driven via the first control channel and the second and third light emitting components are driven jointly via the second control channel, wherein in the first operating range the mixed light is continuously adjustable from the first color to a predefined fourth color, and that in a second operating range the second light emitting component is driven via the second control channel and the first and third light emitting components are driven jointly via the first control channel, wherein in the second operating range the mixed light is continuously adjustable from the fourth color to the second color.

In an illustrative form of expression, therefore, three optical channels are driven by means of only two control channels. The first optical channel, which is represented by the first light emitting component, is permanently driven via the first control channel. The second optical channel, which is represented by the second light emitting component, is permanently driven via the second control channel. The third optical channel, which is represented by the third light emitting component, is driven either together with the first optical channel via the first control channel or together with the second optical channel via the second control channel depending on the operating range. The use of the three optical channels and the coupling of two of these channels within an operating range enable the driving of the three optical channels by means of the two control channels. Compared with the use of only two optical channels, this results in an approximation of the color of the generated mixed light to the Planckian locus. In this case, the approximation may be so good that the color of the generated light is continuously perceived as white or at least approximately white. Compared with the driving by means of three control channels, the use of only two control channels for driving the three optical channels contributes to the fact that the corresponding control device is producible in a particularly simple and/or cost-effective manner.

In various embodiments, in the first operating range, in the chromaticity diagram the color of the mixed light can lie at the first color and be shifted toward a region between the second color and the third color. After the changeover into the second operating range, in the chromaticity diagram the color of the mixed light can be shifted from a region between the first and third colors toward the second color.

In various embodiments, the first color is warm white, the second color is cold white and/or the third color is green. This contributes to the fact that the color of the generated mixed light is able to be approximated particularly well to the Planckian locus 20.

In the context of this application, colors designated as warm white are those which lie on the Planckian locus 20 and whose color temperature is between 1000 K and 3300 K. Moreover, in the context of this application, colors designated as warm white are those whose $c_X$ and/or $c_Y$ color coordinates are separated from the color coordinates of the warm white colors on the Planckian locus 20 by a maximum of 0.05 unit, for example by 0.02 unit, for example by 0.01 unit. All warm white colors form a warm white color temperature range.

In the context of this application, colors designated as neutral white are those which lie on the Planckian locus 20 and whose color temperature is between 3300 K and 5000 K.

In the context of this application, colors designated as cold white are those which lie on the Planckian locus 20 and whose color temperature is between 5000 K and 10 000 K. Moreover, in the context of this application, colors designated as cold white are those whose $c_X$ and/or $c_Y$ color coordinates are separated from the color coordinates of the warm white colors on the Planckian locus 20 by a maximum of 0.05 unit, for example by 0.02 unit, for example by 0.01 unit. All cold white colors form a cold white color temperature range.

In various embodiments, a color temperature of the fourth color is less than a color temperature of the first color and greater than a color temperature of the second color. This contributes to the fact that the color of the generated mixed light is continuously tunable between the first color and the second color.

In various embodiments, the control device is configured such that the light emitting components which are driven via the same control channel are electrically connected in parallel or electrically connected in series. This makes it possible, in a simple manner, to operate the corresponding light emitting components jointly and/or with the same energy and/or to supply them with the same voltage and/or the same current.

In various embodiments, the control device is configured such that the generated mixed light is continuously adjusted from the first color to the fourth color by virtue of the fact that in the first operating range a ratio of a current that flows via the first control channel to a current that flows via the second control channel is continuously reduced, and/or that the generated mixed light is continuously adjusted from the fourth color to the second color by virtue of the fact that in the second operating range a ratio of a current that flows via the second control channel to a current that flows via the first control channel is continuously increased. This contributes to the fact that the color of the mixed light is continuously tunable from the first color to the second color and simultaneously lies near the Planckian locus.

In various embodiments, the light emitting components and the control device are configured such that in a chromaticity diagram a color profile of the mixed light from the first color to the fourth color and from the fourth color to the second color is in each case a straight line. This enables a linear approximation to the Planckian locus in a simple manner.

In various embodiments, the straight lines in the chromaticity diagram represent a linear approximation to the Planckian locus in the chromaticity diagram. This contributes to the fact that the color of the mixed light in the case of each setting is perceived as white or at least approximately white.

Various embodiments provide a method for operating a light emitting assembly, wherein: a first light emitting component is driven such that it emits light of a first color; a second light emitting component is driven such that it emits light of a second color, which is different than the first color; at least one third light emitting component is driven such that it emits light of a third color, which is different than the first color and the second color, wherein the light emitting components are arranged such that the first light, the second light and the third light mix to form a mixed light; and in a first operating range the first light emitting component is driven independently of the second and third light emitting components and the second and third light emitting components are driven jointly, wherein in the first operating range the mixed light is continuously adjustable from the first color to a predefined fourth color; and in a second operating range the second light emitting component is driven independently of the first and third light emitting components and the first and third light emitting components are driven jointly, wherein in the second operating range the mixed light is continuously adjustable from the fourth color to the second color.

The above-explained developments and/or advantages of the light emitting assembly can readily be applied to the method for operating the light emitting assembly. Therefore, at least in part, a repeated presentation of the developments and/or advantages is dispensed with.

In various embodiments, the first color is warm white, the second color is cold white and/or the third color is green.

In various embodiments, a color temperature of the fourth color is less than a color temperature of the first color and greater than a color temperature of the second color.

In various embodiments, the light emitting components which are driven jointly are electrically connected in parallel or electrically connected in series.

In various embodiments, the generated mixed light is continuously adjusted from the first color to the fourth color by virtue of the fact that in the first operating range a ratio of a current that flows via the first light emitting component to a current that flows via the second and third light emitting components is continuously reduced. Alternatively or additionally, the generated mixed light is continuously adjusted from the fourth color to the second color by virtue of the fact that in the second operating range a ratio of a current that flows via the second light emitting component to a current that flows via the first and third light emitting components is continuously increased.

In various embodiments, in a chromaticity diagram a color profile of the mixed light from the first color to the fourth color and from the fourth color to the second color is in each case a straight line.

In various embodiments, the straight lines in the chromaticity diagram represent a linear approximation to the Planckian locus.

In various embodiments, the chromaticity diagram is the CIE standard chromaticity diagram.

A light emitting assembly includes three, optionally four or more light emitting components. A light emitting assembly also includes a control device having a plurality of electronic components.

An electronic component may include for example an active and/or a passive component. An active electronic component may include for example a computing, storage and/or regulating unit and/or include a transistor. A passive electronic component may include for example a capacitor, a resistor, a diode or a coil.

In various embodiments, a light emitting component can be a light emitting semiconductor component and/or can be configured as a light emitting diode (LED), as an organic light emitting diode (OLED), as a light emitting transistor or as an organic light emitting transistor. The light can be for example light in the visible range, UV light and/or infrared light. In various embodiments, a light emitting component can be part of an integrated circuit. Furthermore, a plurality of light emitting components can be provided, for example in a manner accommodated in a common housing.

FIG. 1 shows one example of a chromaticity diagram. In particular, FIG. 1 shows an excerpt from the CIE standard chromaticity diagram. The Planckian locus 20, also referred to as black-body curve, and a first color 22, a second color 24 and a third color 26 are depicted in the chromaticity diagram. Each color corresponds to an individual pair of color coordinates $c_X$, $c_Y$ that can be read on the X-axis and the Y-axis of the chromaticity diagram. A first straight line 32 connects the first color 22 to the second color 24. A second straight line 34 connects the second color 24 to the third color 26. A third straight line 36 connects the first color 22 and the third color 26. For more detailed explanations concerning the chromaticity diagram shown in FIG. 1, in order to avoid repetition, reference is made to the introductory part of this description.

Figure 2:
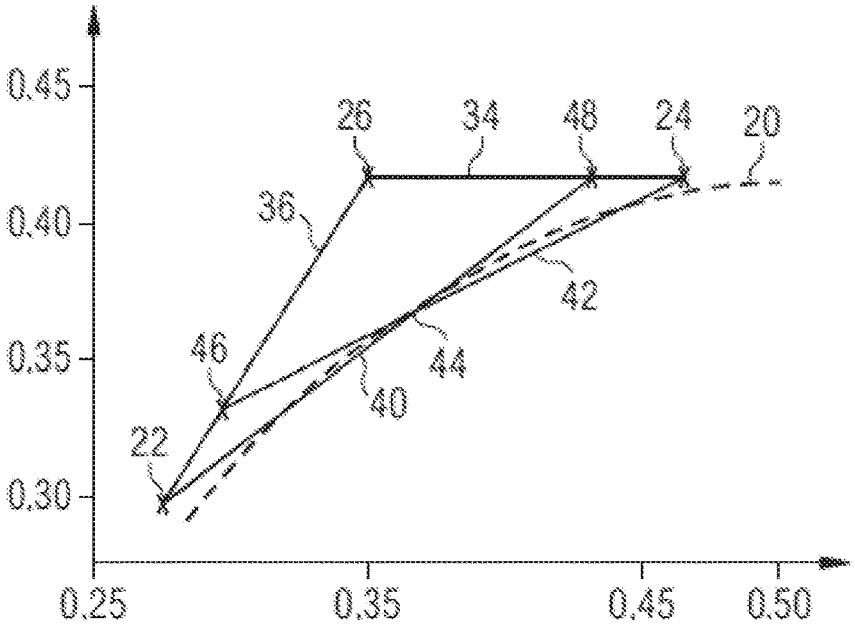
FIG. 2 shows one example of a chromaticity diagram.

FIG. 2 shows one example of a chromaticity diagram. The chromaticity diagram largely corresponds to the chromaticity diagram shown in FIG. 1. A fourth color 44, a fifth color 46 and a sixth color 48 are plotted in the chromaticity diagram. The fifth color 46 lies on the third straight line 36 and the sixth color 48 lies on the second straight line 34.

The fifth color 46 can be generated by means of mixing light of the first color 22 and light of the third color 26. The sixth color 48 can be generated by means of mixing light of the second color 24 and light of the third color 26.

If light of the first color 22 is mixed with light of the sixth color 48, then depending on the light intensities of the corresponding light it is possible to set a color of the corresponding mixed light along a first color profile 40, which forms a straight line in the chromaticity diagram. If light of the second color 24 is mixed with light of the fifth color 46, then depending on the light intensities of the corresponding light it is possible to set a color of the corresponding mixed light along a second color profile 42, which forms a straight line in the chromaticity diagram. The first color profile 40 and the second color profile 42 intersect at a point of intersection, wherein the point of intersection is representative of the fourth color 44.

That section of the first color profile 40 which lies to the left of the fourth color 44 in the chromaticity diagram and that section of the second color profile 42 which lies to the right of the fourth color 44 in the chromaticity diagram jointly form a linear approximation to the Planckian locus 20.

Figure 3:
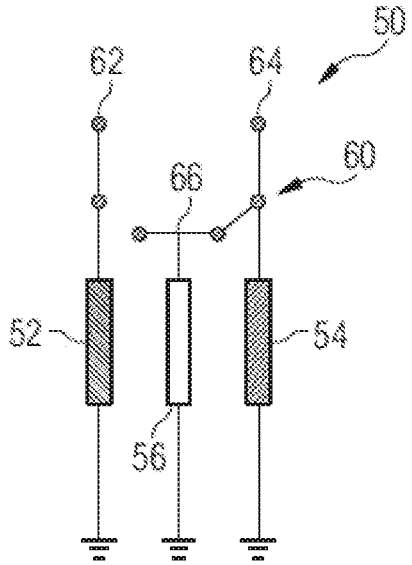
FIG. 3 shows a basic schematic diagram of one embodiment of a light emitting assembly.

FIG. 3 shows a basic schematic diagram of one embodiment of a light emitting assembly 50. The light emitting assembly 50 includes a first light emitting component 52, a second light emitting component 54, a third light emitting component 56 and a control device 60, only part of the control device 60 being indicated in the figures.

The first light emitting component 52 represents a first optical channel and emits light of a first color, in particular the first color 22, during operation. The second light emitting component 54 represents a second optical channel and emits light of a second color, e.g. the second color 24, during operation. The third light emitting component 56 represents a third optical channel and emits light of a third color, e.g. the third color 26, during operation. The light emitting components 52, 54, 56 are arranged in such a way that the light emitted by them mixes to form a mixed light. The light emitting assembly 50 emits the mixed light.

The control device 60 includes a first control channel 62, a second control channel 64 and a switching element 66. The control channels 62, 64 can also be referred to as output channels of the control device 60. The first control channel 62 is electrically connected permanently to the first optical channel, in particular to the first light emitting component 52. The second control channel 64 is electrically connected permanently to the second optical channel, e.g. to the second light emitting component 54. The switching element 66 can optionally electrically connect the third optical channel, e.g. the third light emitting component 56, to the first control channel 62 or to the second control channel 64. In various embodiments, in a first operating range illustrated in FIG. 3, the second control channel 64 is electrically connected to the third light emitting component 56.

Consequently, in the first operating range the second light emitting component 54 and the third light emitting component 56 are operated jointly by virtue of their being electrically connected in parallel. Therefore, in the first operating range the same voltage is present at the second light emitting component 54 and the third light emitting component 56. In the first operating range the first light emitting component 52 is operated independently of the second and third light emitting components 54, 56 via the first control channel 62. Therefore, in the first operating range a voltage applied to the first light emitting component 52 can be a different voltage than that applied to the second and third light emitting components 54, 56.

If a voltage which is greater than a threshold voltage of the first light emitting component 52 is applied to the first light emitting component 52, and a voltage which is less than a threshold voltage of the second light emitting component 54 and less than a threshold voltage of the third light emitting component 56 is applied to the second and third light emitting components 54, 56, exclusively the first light emitting component 52 emits light of the first color 22. Therefore, in this case the light emitting assembly 50 also emits light of the first color 22, e.g. warm white light.

If a voltage which is less than the threshold voltage of the first light emitting component 52 should be applied to the first light emitting component 52, and a voltage which is greater than the threshold voltage of the second light emitting component 54 and greater than the threshold voltage of the third light emitting component 56 should be applied to the second and third light emitting components 54, 56, exclusively the second light emitting component 54 would emit light of the second color 24 and the third light emitting component 56 would emit light of the third color 26. The light of the second color 24 and the light of the third color 26 would mix and form light of the sixth color 48. Therefore, in this case the light emitting assembly 50 would emit light of the sixth color 22.

If a voltage which is greater than the threshold voltage of the first light emitting component 52 is applied to the first light emitting component 52, and a voltage which is greater than the threshold voltage of the second light emitting component 54 and greater than the threshold voltage of the third light emitting component 56 is applied to the second and third light emitting components 54, 56, all three light emitting components 52, 54, 56 emit light. A color of the mixed light generated as a result can be set along the first color profile 40 depending on a ratio of the currents flowing through the control channels 62, 64 and the corresponding light emitting components 52, 54, 56 on account of the applied voltages.

In this way, in the first operating range the color of the mixed light is set proceeding from the first color 22 along the first color profile 40 to the fourth color 44. When the fourth color 44 is reached, a changeover to a second operating range is effected.

Figure 4:
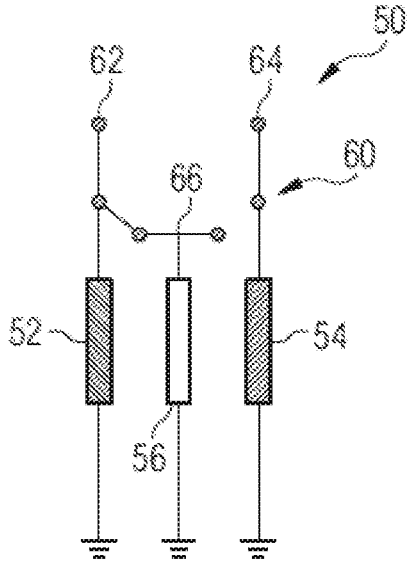
FIG. 4 shows a basic schematic diagram of one embodiment of a light emitting assembly.

FIG. 4 shows a basic schematic diagram of one embodiment of a light emitting assembly, e.g. of the light emitting assembly 50 explained with reference to FIG. 3, in the second operating range, in which the switching element 66 electrically connects the third light emitting component 56 to the first control channel 62. Consequently, in the second operating range the first light emitting component 52 and the third light emitting component 56 are operated jointly via the first control channel 62 by virtue of their being electrically connected in parallel. Therefore, in the second operating range the same voltage is present at the first light emitting component 52 and the third light emitting component 56. In the second operating range the second light emitting component 54 is operated independently of the first and third light emitting components 52, 56 via the second control channel 64. Therefore, in the second operating range a voltage applied to the second light emitting component 54 can be a different voltage than that applied to the first and third light emitting components 52, 56.

If a voltage which is greater than a threshold voltage of the second light emitting component 54 is applied to the second light emitting component 54, and a voltage which is less than a threshold voltage of the first light emitting component 52 and less than a threshold voltage of the third light emitting component 56 is applied to the first and third light emitting components 52, 56, exclusively the second light emitting component 54 emits light of the second color 24. Therefore, in this case the light emitting assembly 50 also emits light of the second color 24, e.g. cold white light.

If a voltage which is less than the threshold voltage of the second light emitting component 54 should be applied to the second light emitting component 54, and a voltage which is greater than the threshold voltage of the first light emitting component 52 and greater than the threshold voltage of the third light emitting component 56 should be applied to the first and third light emitting components 52, 56, exclusively the first light emitting component 52 would emit light of the first color 22 and the third light emitting component 56 would emit light of the third color 26. The light of the first color 22 and the light of the third color 26 would mix and form light of the fifth color 46. Therefore, in this case the light emitting assembly 50 would emit light of the fifth color 46.

If a voltage which is greater than the threshold voltage of the second light emitting component 54 is applied to the second light emitting component 54, and a voltage which is greater than the threshold voltage of the first light emitting component 52 and greater than the threshold voltage of the third light emitting component 56 is applied to the first and third light emitting components 52, 56, all three light emitting components 52, 54, 56 emit light. A color of the mixed light generated as a result can be set along the second color profile 42 depending on a ratio of the currents flowing through the control channels 62, 64 and the corresponding light emitting components 52, 54, 56 on account of the applied voltages.

In this way, in the second operating range the color of the mixed light is set proceeding from the fourth color 44 along the second color profile 42 to the second color 24.

Consequently, the three optical channels of the light emitting assembly 50 are operated by means of only two control channels 62, 64. The color of the light emitted by means of the light emitting assembly 50 can be set along a color profile which corresponds to the first color profile 40 to the left of the fourth color 44 in the chromaticity diagram and which corresponds to the second color profile 42 to the right of the fourth color 44 in the chromaticity diagram. These two sections of the color profiles 40, 42 are linear in each case, such that a linear approximation of the color profile of the emitted light to the Planckian locus 20 is effected overall over the two operating ranges. Consequently, by means of the light emitting assembly 50 it is possible to generate light whose color profile is approximated to the Planckian locus 20, specifically by means of a control device 60 having only two control channels 62, 64.

In the embodiment of the light emitting assembly 50 as explained with reference to FIGS. 3 and 4, each of the optical channels includes only one light emitting component. This embodiment was chosen and described in order that the fundamental principle of the concept underlying this application can be explained and illustrated in a simple manner. In another embodiment, however, it may be expedient for one, two or all three optical channels to include in each case more than one light emitting component, for example in each case two, three or more light emitting components, wherein all the light emitting components of one of the optical channels emit light of the same color. Arranging a plurality of light emitting components per optical channel may have optical grounds, for example. By way of example, in order to achieve a desired luminous flux, a desired light intensity, a desired chromaticity and/or a desired brightness of one of the optical channels, the corresponding optical channel can be equipped with a plurality of light emitting components. Furthermore, in order to achieve a desired chromaticity, the color of the light emitted by the light sources can be taken into account. By way of example, in the case of the green light emitting optical channel, relatively few third light emitting components can be used if the latter emit saturated green and/or deep-green light, compared with the use of third light emitting components which emit normal green or bright green light. Alternatively or additionally, one or more of the optical channels may include a plurality of light emitting components in order that a driving of the optical channels by means of the control device 60 is possible in a particularly simple and/or advantageous manner. By way of example, the load of the corresponding optical channel can be set via the number of light emitting components in an optical channel. This may be provided, for example, since the loads of two optical channels can then be predefined such that they are identical or at least approximately identical. Upon the changeover between the first operating range and the second operating range, a voltage change of the voltages applied via the control channels 62, 64 can then be kept particularly small. This can contribute to the fact that the control device 60 can be configured in a simple and/or cost-effective manner.

FIG. 5 to FIG. 16 illustrate an example for simulating the function of a light emitting assembly, for example the light emitting assembly 50 explained above. The simulation may firstly serve to find suitable light emitting components 52, 54, 56 and/or a suitable number of light emitting components 52, 54, 56 in order that the above-explained linear approximation of the color profile of the light of the light emitting assembly 50 to the Planckian locus 20 is possible. Furthermore, FIG. 5 to FIG. 16 can serve as evidence that the linear approximation of the color profile of the emitted light to the Planckian locus 20 is possible by means of the light emitting assembly 50, e.g. by means of driving three optical channels by means of two control channels 62, 64.

Figure 5:
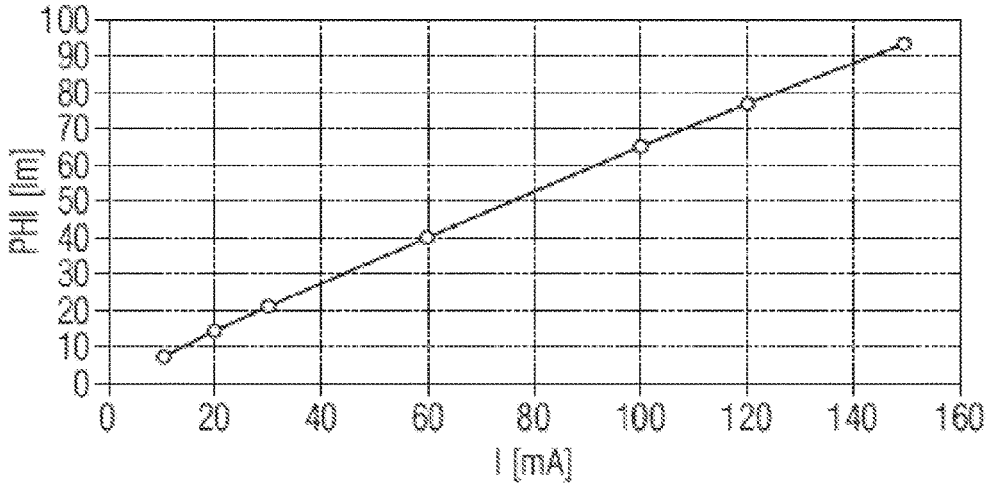
FIG. 5 shows one example of a luminous flux-current diagram.

FIG. 5 shows a simulation of a luminous flux-current diagram, in which a luminous flux PHI of first light, which is generated by means of the first optical channel and which is warm white, is plotted as a function of a current I that flows via the first optical channel.

Figure 6:
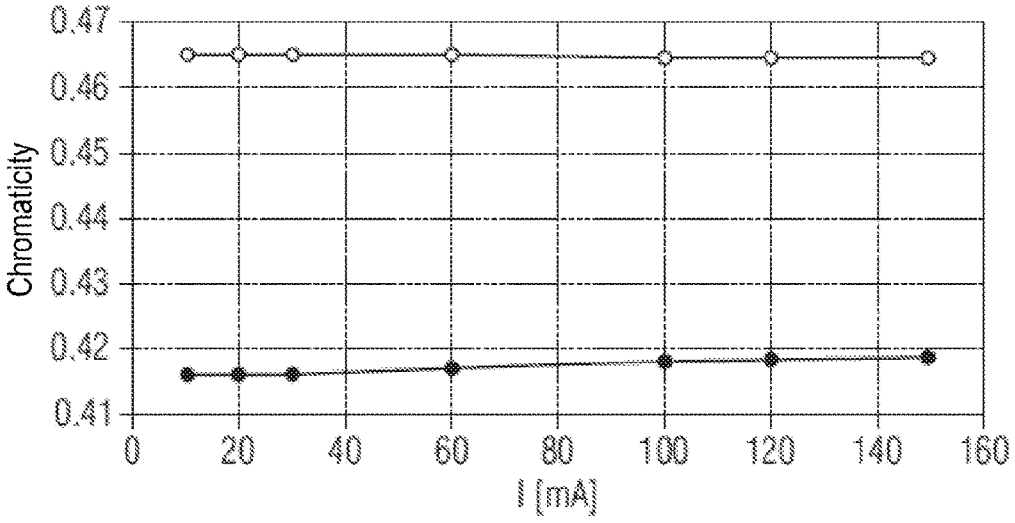
FIG. 6 shows one example of a chromaticity-current diagram.

FIG. 6 shows a simulation of a chromaticity-current diagram, in which a chromaticity of the first light is plotted as a function of the current I, wherein the upper straight line in the chromaticity-current diagram shows a profile of the $c_X$ color coordinates and the lower straight line shows a profile of the $c_Y$ color coordinates.

Figure 7:
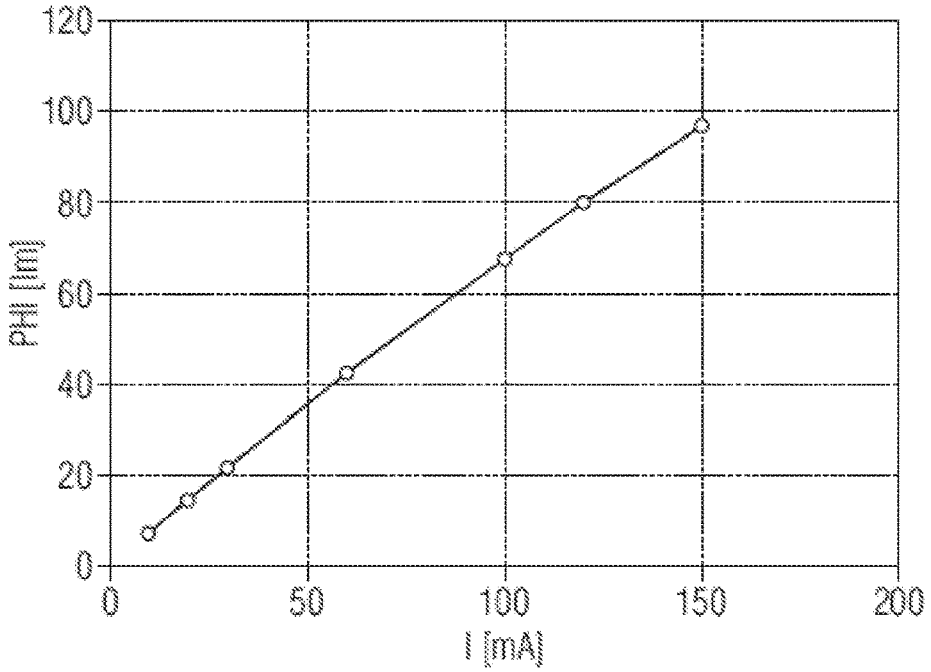
FIG. 7 shows one example of a luminous flux-current diagram.

FIG. 7 shows a simulation of a luminous flux-current diagram, in which a luminous flux PHI of second light, which is generated by means of the second optical channel and which is cold white, is plotted as a function of a current I that flows via the second optical channel.

Figure 8:
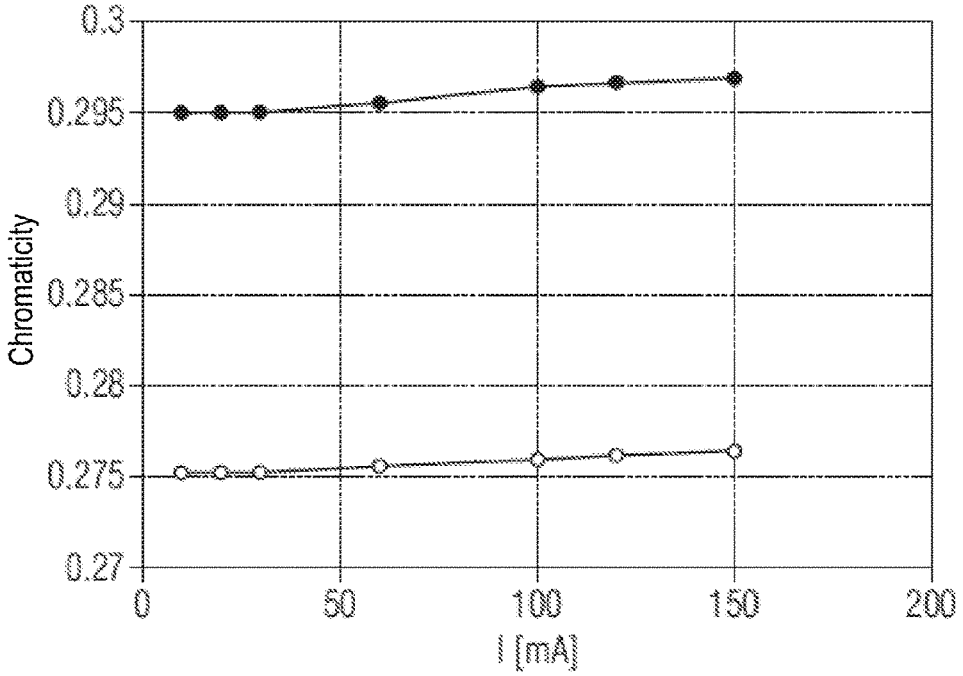
FIG. 8 shows one example of a chromaticity-current diagram.

FIG. 8 shows one example of a chromaticity-current diagram, in which a chromaticity of the second light is plotted as a function of the current I, wherein the upper straight line in the chromaticity-current diagram shows a profile of the $c_Y$ color coordinates and the lower straight line shows a profile of the $c_X$ color coordinates.

Figure 9:
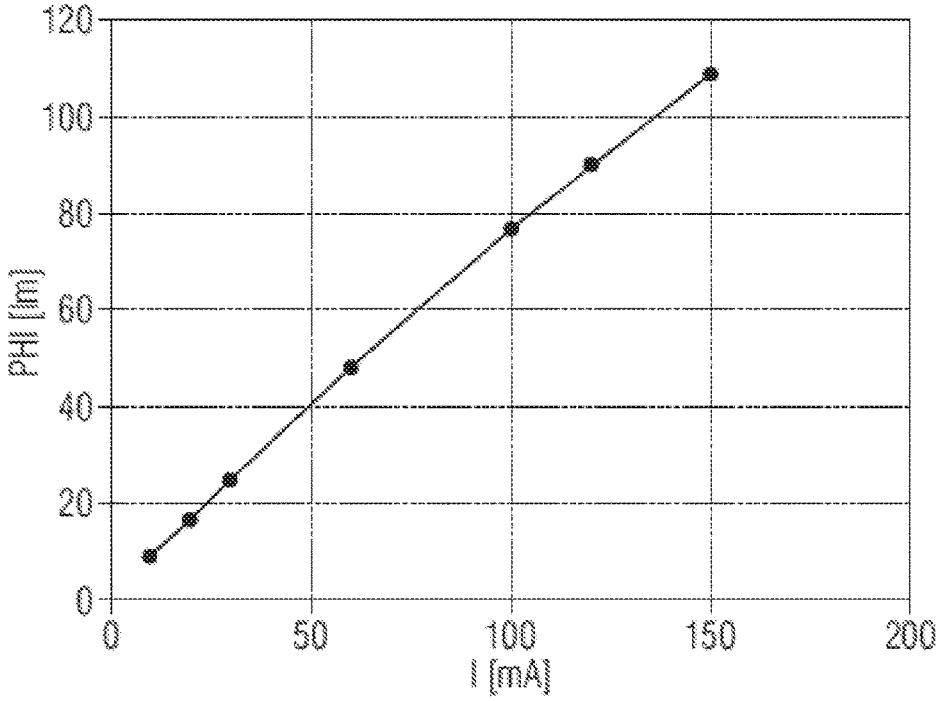
FIG. 9 shows one example of a luminous flux-current diagram.

FIG. 9 shows a simulation of a luminous flux-current diagram, in which a luminous flux PHI of third light, which is generated by means of the third optical channel and which is green, is plotted as a function of a current I that flows via the third optical channel.

Figure 10:
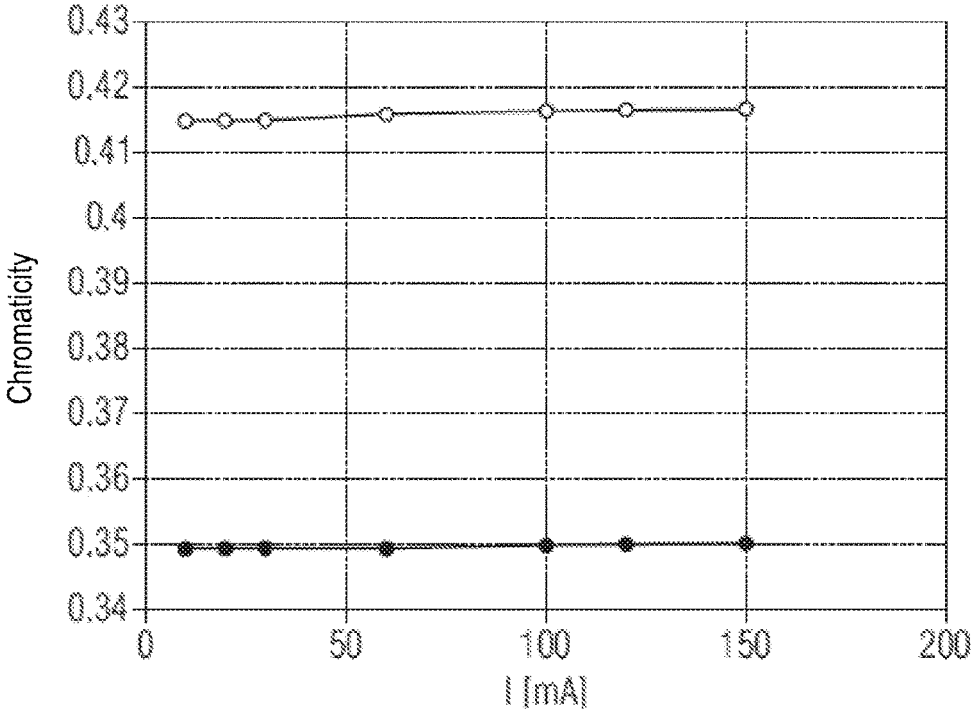
FIG. 10 shows one example of a chromaticity-current diagram.

FIG. 10 shows one example of a chromaticity-current diagram, in which a chromaticity of the third light is plotted as a function of the current I, wherein the upper straight line in the chromaticity-current diagram shows a profile of the $c_X$ color coordinates and the lower straight line shows a profile of the $c_Y$ color coordinates.

Mathematical functions can be assigned to the diagrams shown in FIG. 5 to FIG. 10. These functions make it possible to represent the luminous flux and the chromaticity of the individual optical channels as a function of the forward current that flows through the corresponding optical channel. The tables below show simulated values of three optical channels, wherein the first optical channel 30 includes LEDs that emit warm white light, the second optical channel 20 includes LEDs that emit cold white light, and the third optical channel 10 includes LEDs that emit green light. The respective numbers of the LEDs were chosen such that it is possible to electrically connect the third optical channel in parallel with the first optical channel or the second optical channel. Furthermore, it is assumed that the LEDs of the first optical channel are arranged in three mutually parallel branches each having ten in series-connected LEDs and that the LEDs of the second optical channel are arranged in two parallel branches each having ten LEDs.

FIG. 11 shows one example of a first table, in which the color coordinates, the luminous fluxes, the currents I and the number of LEDs for the first optical channel, which emits warm white WW light, for the second optical channel, which emits cold white CW light, and for the third optical channel, which emits green G light, are entered, wherein the currents flowing via the optical channels are all of identical magnitude, e.g. are equal to 80 mA. Furthermore, FIG. 11 shows what color coordinates, what luminous flux and what CCT values result for the corresponding mixed light.

FIG. 12 shows one example of a second table, in which the color coordinates, the luminous fluxes, the currents I and the number of LEDs for the first optical channel, which emits warm white WW light, for the second optical channel, which emits cold white CW light, and for the third optical channel, which emits green G light, are entered, wherein the currents flowing via the first optical channel and the third optical channel are of identical magnitude, in particular are equal to 120 mA, and the current flowing via the second optical channel is almost zero, in particular equal to 1 mA. This situation might arise for example if the second and third optical channels are operated jointly and the first optical channel is operated independently of the second and third optical channels. Furthermore, FIG. 12 shows what color coordinates, what luminous flux and what CCT values would result for the corresponding mixed light. In particular, the corresponding mixed light would have the sixth color 48.

FIG. 13 shows one example of a third table, in which the color coordinates, the luminous fluxes, the currents I and the number of LEDs for the first optical channel, which emits warm white WW light, for the second optical channel, which emits cold white CW light, and for the third optical channel, which emits green G light, are entered, wherein the currents flowing via the second optical channel and the third optical channel are of identical magnitude, in particular are equal to 120 mA, and the current flowing via the first optical channel is almost zero, e.g. equal to 1 mA. This situation might arise for example if the second and third optical channels are operated jointly and the first optical channel is operated independently of the second and third optical channels. Furthermore, FIG. 13 shows what color coordinates, what luminous flux and what CCT values would result for the corresponding mixed light. In various embodiments, the corresponding mixed light would have the fifth color 46.

Figures 14, 14A:
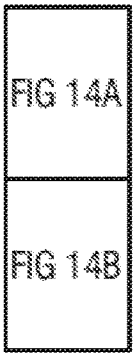
FIG. 14 shows one example of a fourth table.

FIG. 14 shows one example of a fourth table, in which the color coordinates, the luminous fluxes, the currents I and the number of LEDs for the first optical channel, which emits warm white WW light, for the second optical channel, which emits cold white CW light, and for the third optical channel, which emits green G light, are entered. The currents of between 10 mA and 150 mA that flow via the optical channels are varied in this case such that the above-explained color profile of the light emitted by the light emitting assembly 50 is achieved, wherein the entire color profile starts at the second color 24 and extends along the second color profile 42 via the fourth color 44 along the first color profile 40 toward the first color 22 and wherein a changeover from the second operating range to the first operating range is effected at the fourth color 44.

Figure 15:
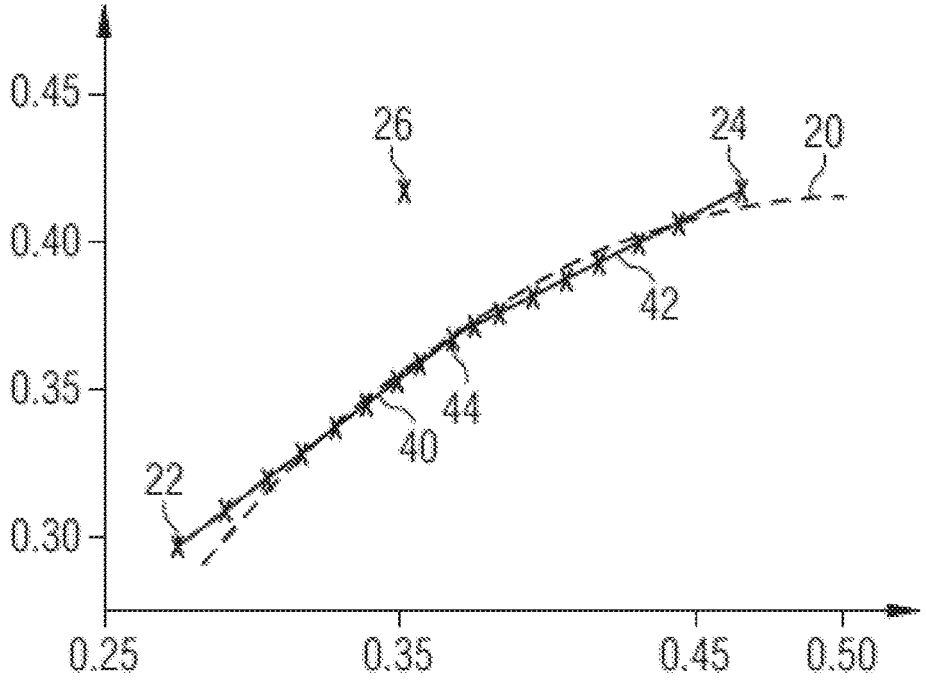
FIG. 15 shows one example of a chromaticity diagram.

FIG. 15 shows one example of a chromaticity diagram in which are plotted the colors whose color coordinates and CCT values result during the simulation and are illustrated in the fourth table. In various embodiments, FIG. 15 shows that the color profile of the light emitted by means of the light emitting assembly 50 represents the linear approximation to the Planckian locus 20.

Figure 16:
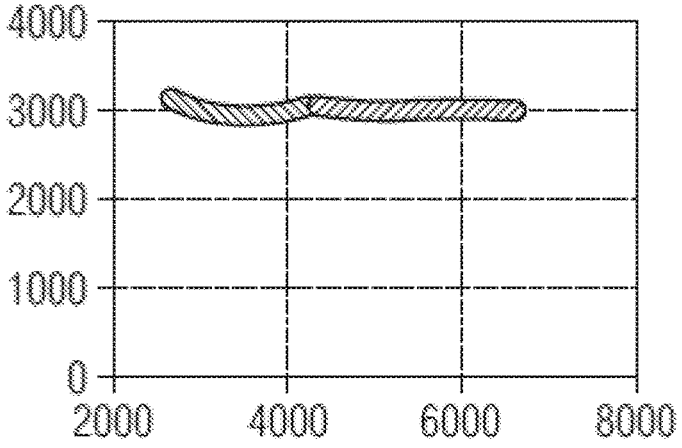
FIG. 16 shows one example of a luminous flux-color temperature diagram.

FIG. 16 shows one example of a luminous flux-color temperature diagram, in which a luminous flux of the light emitted by means of the light emitting assembly 50 is plotted as a function of the color temperature of said light. FIG. 16 reveals that, by means of the light emitting assembly 50, it is possible to provide light having an almost constant luminous flux over a very wide color temperature range, e.g. from warm white to cold white.

Figure 17:
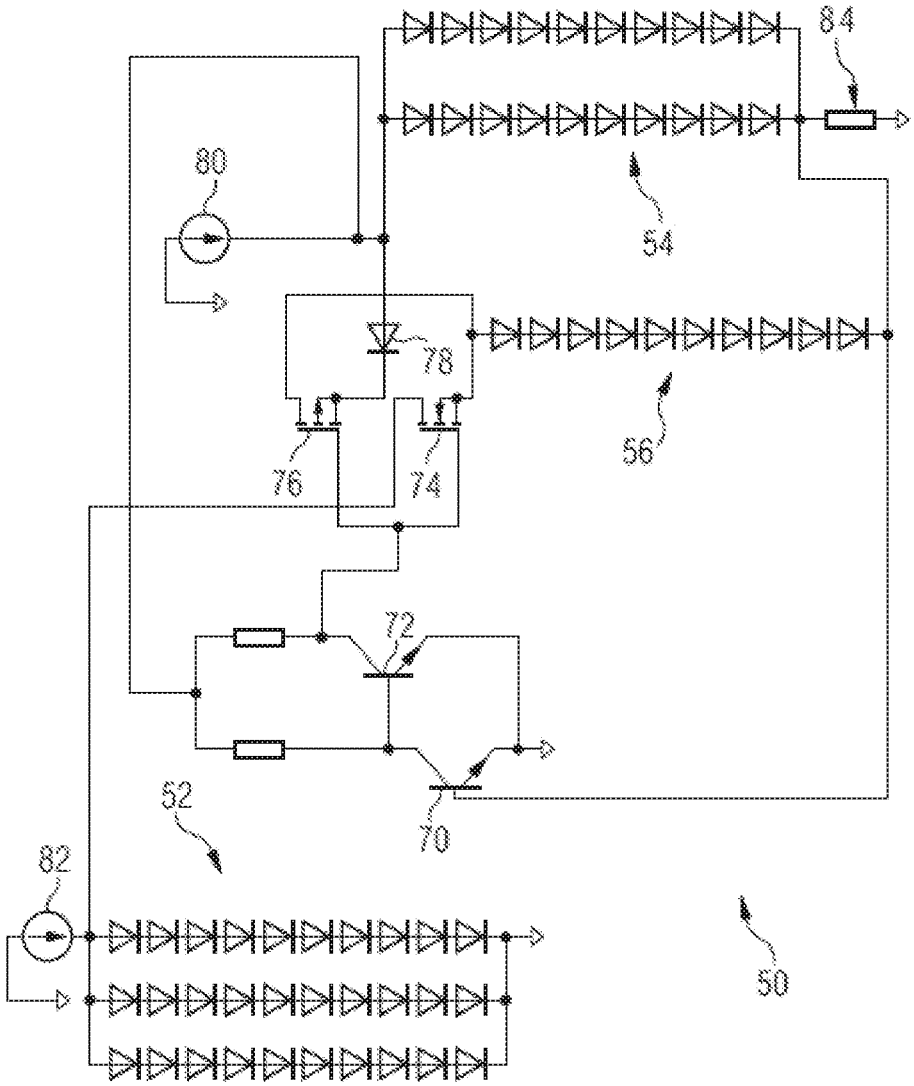
FIG. 17 shows a circuit diagram of one embodiment of a light emitting assembly.

FIG. 17 shows a circuit diagram of one embodiment of a light emitting assembly, e.g. the light emitting assembly 50, which is taken as a basis for the simulation explained above.

The light emitting assembly 50 includes thirty first light emitting components 52 arranged in three groups, wherein the groups are electrically connected in parallel with one another and wherein, within the groups, the first light emitting components 52 are electrically connected in series. The light emitting assembly 50 includes twenty second light emitting components 54 subdivided into two groups, wherein the groups are electrically connected in parallel with one another and wherein, within the groups, the second light emitting components 54 are electrically connected in series. The light emitting assembly 50 includes ten third light emitting components 56, which are electrically connected in series.

The light emitting assembly 50 includes a first transistor 70, which is configured as an NPN transistor and whose base is electrically connected in series with the second light emitting components 54. The light emitting assembly 50 includes a second transistor 72, which is configured as an NPN transistor and whose emitter is electrically connected to the emitter of the first transistor 70 and whose base is electrically connected to the collector of the first transistor 70. The light emitting assembly 50 includes a third transistor 74, which is configured as an n-channel insulated gate field effect transistor and whose gate is electrically connected to the collector of the second transistor 72, and a fourth transistor 76, which is configured as a p-channel insulated gate field effect transistor and whose gate is electrically connected to the collector of the second transistor 72. The light emitting assembly includes a diode 78, which is electrically arranged between the source of the fourth transistor 76 and the second light emitting components 54. A drain of the fourth transistor 76 is electrically connected firstly to a source of the third transistor 74 and secondly to the third light emitting components 56. A first current source 80 corresponds to the first control channel 62 and is electrically connected to the first light emitting components 52. A second current source 82 corresponds to the second control channel 64 and is electrically connected to the diode 78 and the second light emitting components 54. A measuring resistor 84 is electrically connected in series with the second light emitting components 54. The measuring resistor 54 has a resistance value of 4.4 ohms, for example.

In the first operating range, the value of the current that is introduced into the light emitting assembly 50 by means of the second current source 82 is low. Therefore, the voltage across the measuring resistor 84 is low, for example less than 600 mV. Therefore, the first transistor 70 is switched off and the second transistor 72 is switched on. That means that the gate voltage of the third transistor 74 (n-channel) and of the fourth transistor 76 (p-channel) is low and, consequently, the fourth transistor 76 is switched on and the third transistor 74 is switched off. As a result, the second light emitting components 54 and the third light emitting components 56 are connected in parallel and the optical channel having the first light emitting components 52 is separated.

In the second operating range, the value of the current that is introduced by means of the second current source 80 increases and the voltage across the measuring resistor 84 reaches a predefined threshold value, for example 600 mV or more, earlier or later. As a result, the first transistor 70 is switched on and the second transistor 72 is switched off. One result of this is that the gate voltage of the third transistor 74 and of the fourth transistor 76 is high. This has the effect that the fourth transistor 76 switches off and the third transistor 74 switches on. As a result, the third light emitting components 56 are connected in parallel with the first light emitting components 52 and the second light emitting components 54 are separated.

The invention is not restricted to the embodiments indicated. By way of example, the light emitting assembly 50 may include more or fewer light emitting components 52, 54, 56. Alternatively or additionally, the optical channels, e.g. the light emitting components 52, 54, 56 and/or the corresponding groups of light emitting components 52, 54, 56, in the cases in which they are operated jointly, can be electrically connected in series, instead of being electrically connected in parallel. In these cases, it is advantageous if the third light emitting components 56 emit light of a strongly saturated green, in other words deep-green light, since the number of required third light emitting components 56 and hence a voltage for operating the third light emitting components 56 can then be kept relatively small, which contributes to a merely small change in a control voltage to be applied upon the changeover from the first operating range into the second operating range, and vice versa. Furthermore, the measuring resistor 84 can have a different resistance value.

LIST OF REFERENCE SIGNS

Planckian locus 20
first color 22
second color 24
third color 26
first straight line 32
second straight line 34
third straight line 36
first color profile 40
second color profile 42
fourth color 44
fifth color 46
sixth color 48
light emitting assembly 50
first light emitting component 52
second light emitting component 54
third light emitting component 56
control device 60
first control channel 62
second control channel 64 switching element 66
first transistor 70
second transistor 72
third transistor 74
fourth transistor 76
fifth transistor 78
first current source 80
second current source 82
measuring resistor 84
warm white WW
cold white CW
green G While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A light emitting assembly, comprising:

a first light emitting component, which emits light of a first color, a second light emitting component, which emits light of a second color, which is different than the first color, at least one third light emitting component, which emits light of a third color, which is different than the first color and the second color, wherein the light emitting components are arranged such that the first light, the second light and the third light mix to form a mixed light, and a control device, which has a first control channel and a second control channel for the purpose of operating the three light emitting components and which is configured such that in a first operating range the first light emitting component is driven via the first control channel and the second and third light emitting components are driven jointly via the second control channel, wherein in the first operating range the mixed light is continuously adjustable from the first color to a predefined fourth color, and that in a second operating range the second light emitting component is driven via the second control channel and the first and third light emitting components are driven jointly via the first control channel, wherein in the second operating range the mixed light is continuously adjustable from the fourth color to the second color.

2. The light emitting assembly of claim 1, wherein at least one of the first color is warm white, or the second color is cold white or the third color is green.

3. The light emitting assembly of claim 1, wherein a color temperature of the fourth color is less than a color temperature of the first color and greater than a color temperature of the second color.

4. The light emitting assembly of claim 1, wherein the control device is configured such that the light emitting components which are driven via the same control channel are electrically connected in parallel or electrically connected in series.

5. The light emitting assembly of claim 1, wherein the control device is configured such that the generated mixed light is continuously adjusted from the first color to the fourth color by virtue of the fact that in the first operating range a ratio of a current that flows via the first control channel to a current that flows via the second control channel is continuously reduced.

6. The light emitting assembly of claim 1, wherein the control device is configured such that the generated mixed light is continuously adjusted from the fourth color to the second color by virtue of the fact that in the second operating range a ratio of a current that flows via the second control channel to a current that flows via the first control channel is continuously increased.

7. The light emitting assembly of claim 1, wherein the light emitting components and the control device are configured such that in a chromaticity diagram a color profile of the mixed light from the first color to the fourth color and from the fourth color to the second color is in each case a straight line.

8. The light emitting assembly of claim 7, wherein the straight lines in the chromaticity diagram represent a linear approximation to the Planckian locus.

9. A method for operating a light emitting assembly, the method comprising:

driving a first light emitting component such that it emits light of a first color, driving a second light emitting component such that it emits light of a second color, which is different than the first color, driving at least one third light emitting component such that it emits light of a third color, which is different than the first color and the second color, wherein the light emitting components are arranged such that the first light, the second light and the third light mix to form a mixed light, and driving in a first operating range the first light emitting component independently of the second and third light emitting components and driving the second and third light emitting components jointly, wherein in the first operating range the mixed light is continuously adjustable from the first color to a predefined fourth color, and driving in a second operating range the second light emitting component independently of the first and third light emitting components and driving the first and third light emitting components jointly, wherein in the second operating range the mixed light is continuously adjustable from the fourth color to the second color.

10. The method of claim 9, wherein at least one of the first color is warm white, or the second color is cold white or the third color is green.

11. The method of claim 9, wherein a color temperature of the fourth color is less than a color temperature of the first color and greater than a color temperature of the second color.

12. The method of claim 9, wherein the light emitting components which are driven jointly are electrically connected in parallel or electrically connected in series.

13. The method of claim 9, wherein the generated mixed light is continuously adjusted from the first color to the fourth color by virtue of the fact that in the first operating range a ratio of a current that flows via the first light emitting component to a current that flows via the second and third light emitting components is continuously reduced.

14. The method of claim 9, wherein the generated mixed light is continuously adjusted from the fourth color to the second color by virtue of the fact that in the second operating range a ratio of a current that flows via the second light emitting component to a current that flows via the first and third light emitting components is continuously increased.

15. The method of claim 9, wherein in a chromaticity diagram a color profile of the mixed light from the first color to the fourth color and from the fourth color to the second color is in each case a straight line.

16. The method of claim 15, wherein the straight lines in the chromaticity diagram represent a linear approximation to the Planckian locus in the chromaticity diagram.

17. The method of claim 15, wherein the chromaticity diagram is the CIE standard chromaticity diagram.

* * * * *